US010196704B2

(12) United States Patent
Yoon et al.

(10) Patent No.: US 10,196,704 B2
(45) Date of Patent: Feb. 5, 2019

(54) STEEL FOR RESISTANCE TO COMPLEX CORROSION FROM HYDROCHLORIC ACID AND SULFURIC ACID, HAVING EXCELLENT WEAR RESISTANCE AND SURFACE QUALITIES

(71) Applicant: POSCO, Pohang-si, Gyeongsangbuk-do (KR)

(72) Inventors: Jeong-Bong Yoon, Pohang-si (KR); Byoung-Ho Lee, Pohang-si (KR); Jong-Hwa Kim, Pohang-si (KR)

(73) Assignee: POSCO, Pohang-si, Gyeongsangbuk-do (KR)

( * ) Notice: Subject to any disclaimer, the term of this patent is extended or adjusted under 35 U.S.C. 154(b) by 308 days.

(21) Appl. No.: 14/917,926

(22) PCT Filed: Nov. 25, 2013

(86) PCT No.: PCT/KR2013/010725
§ 371 (c)(1),
(2) Date: Mar. 9, 2016

(87) PCT Pub. No.: WO2015/037783
PCT Pub. Date: Mar. 19, 2015

(65) Prior Publication Data

US 2016/0215361 A1 Jul. 28, 2016

(30) Foreign Application Priority Data

Sep. 10, 2013 (KR) ..... 10-2013-0108704

(51) Int. Cl.
*C22C 38/02* (2006.01)
*C22C 38/04* (2006.01)
(Continued)

(52) U.S. Cl.
CPC ..... *C21D 9/46* (2013.01); *C21D 1/84* (2013.01); *C21D 6/001* (2013.01); *C21D 6/005* (2013.01);
(Continued)

(58) Field of Classification Search
None
See application file for complete search history.

(56) References Cited

U.S. PATENT DOCUMENTS 5,820,703 A 10/1998 Suzuki et al.
2005/0013722 A1* 1/2005 Usami ..... B23K 35/3053 420/93
(Continued)

FOREIGN PATENT DOCUMENTS

CN 101370952 A 2/2009
CN 101558178 A 10/2009
(Continued)

OTHER PUBLICATIONS

Machine-English translation of JP 2007-262555, Kajima Kazuyuki et al., Oct. 11, 2007.*
(Continued)

*Primary Examiner* — Deborah Yee
(74) *Attorney, Agent, or Firm* — McDermott Will & Emery LLP

(57) ABSTRACT

There are provided a steel sheet for resistance to composite corrosion from sulfuric acid and hydrochloric acid, having excellent wear resistance and surface quality, and a method of manufacturing the same. The steel sheet having excellent surface qualities may be provided by improving resistance to erosion occurring due to coal cinders to increase a lifespan thereof and securing excellent resistance to composite corrosion from sulfuric acid and hydrochloric acid. Wear resistance may be significantly increased by adding P, and in
(Continued)

order to solve a problem in that wear resistance is deteriorated due to the addition of P, a component system and a hot rolling process condition may be controlled, thereby forming a corrosion resistant layer having excellent corrosion resistance.

6 Claims, 1 Drawing Sheet

(51) Int. Cl.

| | |
|---|---|
| ***C22C 38/06*** | (2006.01) |
| ***C22C 38/16*** | (2006.01) |
| ***C22C 38/60*** | (2006.01) |
| ***C22C 38/08*** | (2006.01) |
| ***C21D 9/46*** | (2006.01) |
| ***C21D 8/02*** | (2006.01) |
| ***C22C 38/00*** | (2006.01) |
| ***C21D 1/84*** | (2006.01) |
| ***C21D 6/00*** | (2006.01) |
| ***C22C 38/10*** | (2006.01) |

(52) U.S. Cl.

CPC ..... *C21D 6/007* (2013.01); *C21D 6/008* (2013.01); *C21D 8/02* (2013.01); *C21D 8/0205* (2013.01); *C21D 8/0221* (2013.01); *C21D 8/0226* (2013.01); *C21D 8/0263* (2013.01); *C22C 38/00* (2013.01); *C22C 38/002* (2013.01); *C22C 38/02* (2013.01); *C22C 38/04* (2013.01); *C22C 38/06* (2013.01); *C22C 38/105* (2013.01); *C22C 38/16* (2013.01); *C22C 38/60* (2013.01); *C21D 2211/004* (2013.01)

(56) References Cited

U.S. PATENT DOCUMENTS

| | | | | |
|---|---|---|---|---|
| 2008/0025746 | A1 | 1/2008 | Kanai | |
| 2008/0318029 | A1* | 12/2008 | Nishimura .. | C03C 8/02428/332 |

FOREIGN PATENT DOCUMENTS

| | | | |
|---|---|---|---|
| JP | S59-96244 | A | 6/1984 |
| JP | 09-025536 | A | 1/1997 |
| JP | 10-110237 | A | 4/1998 |
| JP | 2000-054067 | A | 2/2000 |
| JP | 2004-263235 | A | 9/2004 |
| JP | 2005-281841 | A | 10/2005 |
| JP | 2007-239094 | A | 9/2007 |
| JP | 2007-262555 | A | 10/2007 |
| JP | 2007-262558 | A | 10/2007 |
| JP | 2008-174768 | A | 7/2008 |
| JP | 2008-208452 | A | 9/2008 |
| JP | 2008-303445 | A | 12/2008 |
| JP | 2009-513831 | A | 4/2009 |
| KR | 10-2009-0070249 | A | 7/2009 |
| KR | 10-2010-0074553 | A | 7/2010 |
| KR | 10-2012-0011258 | A | 2/2012 |
| KR | 10-2013-0022874 | A | 3/2013 |
| WO | 01/94654 | A1 | 12/2001 |
| WO | 2008/062984 | A1 | 5/2008 |
| WO | 2008/072866 | A1 | 6/2008 |
| WO | 2009/084747 | A1 | 7/2009 |

OTHER PUBLICATIONS

Japanese Office Action dated Apr. 4, 2017 issued in Japanese Patent Application No. 2016-542621 (with English translation).

Written Opinion of the International Search Aurthority and International Search Report dated Jun. 9, 2014 issued in International Patent Applicatioin No. PCT/KR2013/010725.

European Search Report dated May 9, 2016 issued in European Patent Application No. 13893558.0.

China Office Action dated Nov. 3, 2016 issued in Chinese Patent Application No. 201380079479.6 (with English translation).

* cited by examiner

[Fig. 1]
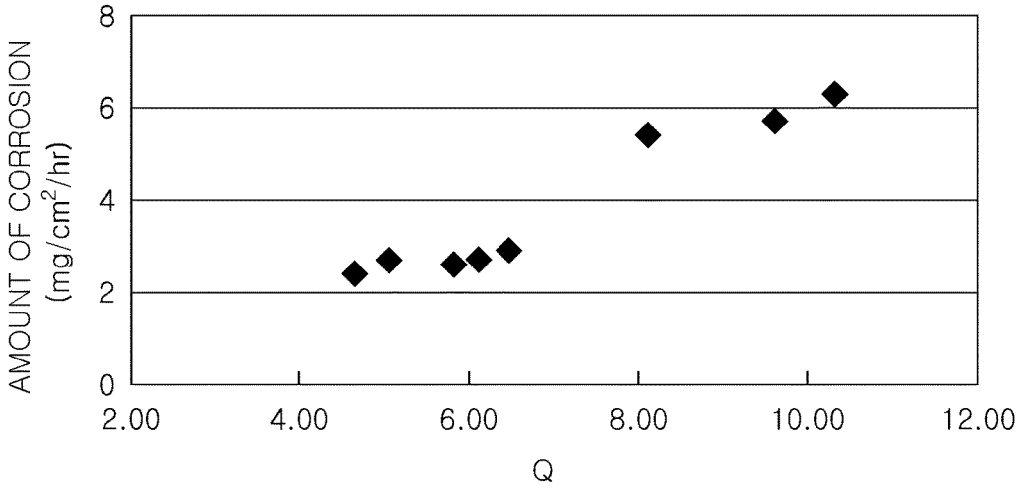
[Fig. 2]
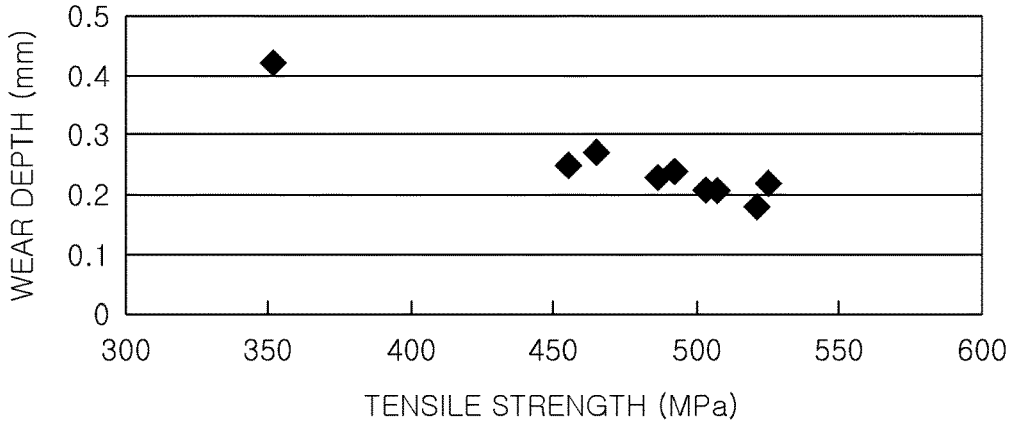

STEEL FOR RESISTANCE TO COMPLEX CORROSION FROM HYDROCHLORIC ACID AND SULFURIC ACID, HAVING EXCELLENT WEAR RESISTANCE AND SURFACE QUALITIES

TECHNICAL FIELD

Aspects of embodiments relate to a steel for resistance to complex corrosion from sulfuric acid and hydrochloric acid, having excellent wear resistance and surface qualities, and a method of manufacturing the same, and more particularly, to a steel for resistance to complex corrosion from sulfuric acid and hydrochloric acid, having excellent wear resistance and surface qualities, and capable of being used in fuel gas treatment equipment for desulfurization or DeNOX facilities used in thermoelectric power plants, and the like, and a method of manufacturing the same.

BACKGROUND ART

In power plants using coal as fuel, etching occurring due to the collision of coal cinders with inner surfaces of pipes and the like, during combustion gas exhausting processes, may be a factor in seriously affecting a lifespan of pipes or structures. In particular, in portions thereof with which coal cinders collide, corrosion may occur faster than in other portions thereof having widened surface areas, as well as the occurrence of etching therein. Such erosion due to coal cinder collisions may be prevented by improving wear resistance. Wear resistance has physical properties in proportion to strength and may be improved by increasing the strength of steel sheets. As a representative method for increasing the strength of steel sheets, solid-solution hardening may be employed, and as representative solid-solution hardening elements, silicon (Si), phosphorus (P) and the like may be used. However, in general, silicon (Si) has a problem in that red scale may occur with the use thereof, and although phosphorus (P) has relatively high reinforcement effects and is relatively cheap, it has been known that P deteriorates corrosion resistance.

In general, it has been known that in the case of corrosion resistant steel for resistance to complex corrosion from sulfuric acid and hydrochloric acid, a large amount of copper (Cu) is added to steel in order to delay the occurrence of corrosion under an atmosphere of sulfuric acid and hydrochloric acid. Although Cu has a remarkable effect of significantly delaying a corrosion speed based on sulfuric acid as compared to other added elements, when a large amount of Cu is added, cracks and the like may occur at the time of performing hot rolling. In addition, since Cu has a relatively low melting point, when a large amount of Cu is added, Cu is extruded, causing the occurrence of cracks in a corner portion, or the like, of slabs to remain as surface defects therein. When portions having such surface defects are exposed to an environment in which corrosion may occur, corrosion may occur therein faster than in other portions, or at the time of processing thereof, fractures may occur therein faster than in other portions. Accordingly, as in Patent Documents 1 to 3 below, steel to which an appropriate amount of Cu is added and other elements are compositely added has been developed, but as the content of Cu is reduced, corrosion resistance is deteriorated.

Meanwhile, during a re-heating process to allow slabs to be subjected to hot rolling, relatively thick scale is formed on surfaces thereof, and a majority of the scale is removed by a high-pressure water jet before and after rough milling is performed. However, when an amount of scale having a component of Fayalite ($Fe_2SiO_4$) is formed, the scale is not completely removed even using a high-pressure water jet, causing the occurrence of red scale after hot rolling is performed and causing stains to remain on surfaces thereof, such that the appearance thereof may be degraded and surfaces may not be uniform. Accordingly, since the formation of corrosion is not uniform in an environment in which corrosion may occur, another defect may occur thereby.

(Patent Document 1) Japanese Patent Laid-Open Publication No. 1997-025536

(Patent Document 2) Japanese Patent Laid-Open Publication No. 1998-110237

(Patent Document 3) Korean Patent Laid-Open Publication No. 2009-0070249

DISCLOSURE OF INVENTION

Technical Problem

An aspect of an embodiment may provide a steel sheet capable of having excellent wear resistance secured therein by controlling a component system and a process condition to be suitable therefor, to improve resistance to erosion occurring due to coal cinders and increase a lifespan thereof, and capable of having excellent surface qualities while securing excellent corrosion resistance in an environment in which sulfuric acid and hydrochloric acid are both present to cause the occurrence of corrosion, and a method of manufacturing the same.

Solution to Problem

An aspect of an embodiment may provide a steel sheet for resistance to composite corrosion from sulfuric acid and hydrochloric acid, having excellent wear resistance and surface qualities, the steel sheet including: carbon (C) of 0.1 weight % or less (except for 0), silicon (Si) of less than 0.1 weight % (except for 0), manganese (Mn) of 0.5 to 1.5 weight %, silicon (S) of 0.02 weight % or less, phosphorous (P) of greater than 0.03 to 0.15 weight %, aluminum (Al) of less than 0.05 weight %, copper (Cu) of 0.1 to 1.0 weight %, nickel (Ni) of 0.1 to 0.4 weight %, cobalt (Co) of 0.03 to 0.1 weight %, antimony (Sb) of 0.05 to 0.15 weight %, remaining iron (Fe), and other inevitably contained impurities; and a single or composite concentration layer formed of one or more selected from a group consisting of copper (Cu), cobalt (Co), nickel (Ni) and antimony (Sb) and formed directly under a surface of the steel sheet to have a thickness of 100 to 300 nm.

An aspect of an embodiment may provide a method of manufacturing a steel sheet for resistance to composite corrosion from sulfuric acid and hydrochloric acid, having excellent wear resistance and surface qualities, the method including: reheating, at a temperature of 1100 to 1300° C., a steel slab including carbon (C) of 0.1 weight % or less (except for 0), silicon (Si) of less than 0.1 weight % (except for 0), manganese (Mn) of 0.5 to 1.5 weight %, silicon (S) of 0.02 weight % or less, phosphorous (P) of greater than 0.03 to 0.15 weight %, aluminum (Al) of less than 0.05 weight %, copper (Cu) of 0.1 to 1.0 weight %, nickel (Ni) of 0.1 to 0.4 weight %, cobalt (Co) of 0.03 to 0.1 weight %, antimony (Sb) of 0.05 to 0.15 weight %, remaining iron (Fe), and other inevitably contained impurities; performing finishing hot rolling on the reheated steel slab at a temperature of 850 to 950° C. to obtain a hot rolled steel sheet; cooling the hot rolled steel sheet at a rate of 60 to 100° C./sec;

coiling the cooled steel sheet at a temperature of 650 to 750° C.; and cooling the coiled steel sheet to 300° C. or lower at a rate of 50 to 100° C./hr.

Advantageous Effects of Invention

According to an embodiment, steel having excellent surface qualities by improving wear resistance through improvements in steel strength to increase a lifespan thereof and forming a corrosion resistant layer through the formation of a concentration layer so as not to easily cause the occurrence of corrosion in an environment in which sulfuric acid and hydrochloric acid are compositely present and capable of having excellent surface qualities by not causing the formation of scale unable to be easily removed.

BRIEF DESCRIPTION OF DRAWINGS

The above and other aspects, features and other advantages will be more clearly understood from the following detailed description taken in conjunction with the accompanying drawings, in which:

FIG. 1 is a graph illustrating a relationship between a Q value and the amount of corrosion in samples according to an embodiment of the inventive concept; and FIG. 2 is a graph illustrating a relationship between tensile strength and a wear depth of samples according to an embodiment of the inventive concept.

BEST MODE FOR CARRYING OUT THE INVENTION

Hereinafter, embodiments will be described in detail with reference to the accompanying drawings.

Embodiments may, however, be embodied in many different forms and should not be construed as being limited to embodiments set forth herein. Rather, these embodiments are provided so that this disclosure will be thorough and complete, and will fully convey the scope of the inventive concept to those skilled in the art. In the drawings, the shapes and dimensions of elements may be exaggerated for clarity.

The inventive concept is provided from research into a solution to defects as described above, by considering that relatively excellent corrosion resistance may be secured in an environment in which corrosion occurs due to use of sulfuric acid and hydrochloric acid, by adding phosphorus (P) so as to significantly improve wear resistance, actively controlling a component system in order to solve a problem in that corrosion resistance is deteriorated due to the addition of P, and controlling a process condition in a hot rolling process to form a corrosion resistant layer having excellent corrosion resistance in an environment in which corrosion may occur.

Hereinafter, embodiments of the inventive concept will be described.

Carbon (C): 0.1 weight % or less (except for 0)

C is an element added to improve steel strength, but when added in an amount exceeding 0.15%, welding properties may be significantly degraded, and thus, the possibility of the occurrence of defects may be relatively high at the time of applying a welding process thereto. Corrosion resistance properties may also be degraded. Therefore, the content of C may be 0.15 weight % or less, and in detail, 0.13 weight % or less. In addition, the content of C may also be 0.12 weight % or less, and in further detail, may be 0.1 weight % or less.

Silicon (Si): Less than 0.1 weight % (except for 0)

Si is an element added to improve resistance to corrosion from sulfuric acid and hydrochloric acid and improve steel strength, but when the content of Si exceeds 0.1 weight %, scale having a component such as fayalite, unable to be easily removed by a high-pressure water jet, may be generated, causing the occurrence of defects such as red scale, such that corrosion is irregularly formed on a steel sheet to be followed by partial corrosion occurring thereon. Thus, the content of Si may be less than 0.1 weight %, and in detail, may be 0.08 weight % or less.

Manganese (Mn): 0.5 to 1.5 weight %

Mn is an element added to prevent the occurrence of hot shortness due to solid solution sulfur by allowing the solid solution sulfur in steel to be precipitated as manganese sulfide so as to exhibit a solid solution hardening effect. When the content of Mn is less than 0.5 weight %, a precipitation amount of MnS is relatively small, and thus, the possibility of the occurrence of hot shortness due to generation of FeS is present, and difficulties in securing target strength may be present. When the content of Mn exceeds 1.5 weight %, the possibility of the occurrence of hot shortness is relatively low, and an effect of an increase in strength, as compared to the added amount thereof, is relatively low. Therefore, the content of Mn may be within a range of 0.5 to 1.5 weight %. In detail, a lower limit of the content of Mn may be 0.6% and an upper limit of the content of Mn may be 1.3 weight %.

Sulfur (S): 0.02 weight % or less

Although S is an impurity inevitably contained in steel due to a manufacturing process thereof, when the content of S exceeds 0.02 weight %, the possibility of the occurrence of defects due to hot shortness is relatively high, and corrosion resistance may be deteriorated. Therefore, the content of S may be controlled to have 0.02 weight % or less.

Phosphorus (P): Greater than 0.03 to 0.15 weight %

P is an element added to significantly improve wear resistance, and in order to secure wear resistance required according to an embodiment of the inventive concept, the content of P may be greater than 0.03 weight %. As the content of P is increased, wear resistance may be improved, but when the content of P exceeds 0.15 weight %, the possibility that blue shortness may occur is present. Therefore, P may be within a range of greater than 0.03 to 0.15 weight %, and in detail, may be within a range of 0.051 to 0.15 weight %.

Aluminum (Al): Less than 0.05 weight %

Al is an element inevitably added at the time of manufacturing Al-killed steel, but when the content of Al is 0.05%, welding properties may be significantly deteriorated. Thus, the content of Al may be controlled to have a content of less than 0.05 weight %.

Copper (Cu): 0.1 to 1.0 weight %

Cu is an element added to serve to delay the occurrence of corrosion under an environment in which corrosion may occur due to sulfuric acid/hydrochloric acid, and in order to obtain such an effect, the content of Cu may be greater than 0.1 weight %. However, when the content of Cu exceeds 1.0 weight %, cracks may occur in a cast slab to thus cause surface defects after rolling is performed. Thus, the content of Cu may be within a range of 0.1 to 1.0 weight %. In detail, a lower limit of the content of Cu may be 0.2 weight %, and an upper limit of the content of Cu may be 0.8 weight %.

Nickel (Ni): 0.1 to 0.4 weight %

Ni is an element added to serve to delay the occurrence of corrosion under an environment in which corrosion may occur due to sulfuric acid/hydrochloric acid, and in order to obtain such an effect, the content of Ni may be greater than 0.1 weight %. However, when the content of Ni exceeds 0.4 weight %, an effect in which corrosion resistance is secured or defects occurring due to the addition of Cu are suppressed may be saturated, causing defects in that production costs are increased. Therefore, the content of Ni may be within a range of 0.1 to 0.4 weight %, and in detail, may be within a range of 0.1 to 0.35 weight %.

Cobalt (Co): 0.03 to 0.1 weight %

Co is an element added to improve corrosion resistance by activating Cu so as to facilitate the generation of corrosion products on a surface thereof in an environment in which corrosion may occur or generating a Co oxide in an environment in which corrosion may occur. In order to obtain the effect described above, the content of Co may be greater than 0.03 weight %. As the content of Co is increased, corrosion resistance is improved, but when the content of Co exceeds 0.1 weight %, since an effect in which corrosion resistance is improved may not be increased as the added amount thereof, the content of Co may be within a range of 0.03 to 0.1 weight %.

Antimony (Sb): 0.05 to 0.15 weight %

Sb is added to steel so as to serve to generate a Sb oxide in an environment in which composite corrosion may occur such that resistance to corrosion from sulfuric acid/hydrochloric acid is significantly increased, and in order to obtain such an effect, the content of Sb may be 0.05 weight %. As the content of Sb is increased, resistance to corrosion is improved, but when the content of Sb exceeds 0.15 weight %, since an effect in which resistance to corrosion is improved may not be increased as compared to the added amount thereof, the content of Sb may be within a range of 0.05 to 0.15 weight %. In detail, a lower limit of the content of Sb may be 0.07 weight %, and an upper limit of the content of Sb may be 0.12 weight %.

On the other hand, a steel sheet proposed according to an embodiment may satisfy the above-mentioned component system, and in order to improve resistance to corrosion and a surface quality, Q and D represented as below may satisfy the conditions of 4.0~7.0 and 0.4~0.6, respectively.

$$4.0 \leq Q = 6 - 3\times Cu - 0.3\times Si - 5\times Sb + 45\times P - 45\times Co \leq 7.0$$

Q indicates the condition to improve resistance to corrosion and a relational expression provided by the present inventors, and a value of Q may satisfy a range of 4.0 to 7.0. When a value of Q exceeds 7.0, it may be difficult to secure an amount of corrosion of 3.0 mg/cm$^2$/Hr or less, according to an embodiment of the inventive concept, such that difficulties in obtaining relatively excellent corrosion resistance may be present. As the value of Q decreases, corrosion resistance may be improved, while when the value of Q is less than 4.0, effects of improvements in resistance to corrosion may not be increased as compared to an addition amount of an alloy element. Thus, the value of Q may satisfy a range of 4.0 to 7.0.

$$0.4 \leq D = Ni/((6 - 3\times Cu - 0.3\times Si - 5\times Sb + 45\times P - 45\times Co)/3) \leq 0.6$$

D indicates the condition provided to improve a surface quality and a relational expression provided by the present inventors, and a value of D may satisfy a range of 0.4 to 0.6. When a value of D is less than 0.4, surface defects may occur due to cracks in edge portions of a slab, while when the value of D exceeds 0.6, the possibility of the occurrence of surface defects may be significantly decreased, but an amount of alloy added thereto may be relatively high, causing an excessive increase in costs thereof.

A steel sheet proposed according to an embodiment may include a single or composite concentration layer formed of one or more selected from a group consisting of copper (Cu), cobalt (Co), nickel (Ni) and antimony (Sb) and having a thickness of 100 to 300 nm, to be formed directly under a surface thereof. First, Cu, Co, Ni or Sb is present as a single concentration layer or is present as a composite concentration layer configured of, for example, (Cu,Sb), (Cu,Co), (Cu,Ni), (Co,Sb), (Co,Ni), (Sb,Ni), (Cu,Sb,Co), (Cu,Sb,Ni), (Cu,Co,Ni), (Sb,Co,Ni) or (Cu,Sb,Co,Ni), at the time of manufacturing a steel material. Then, in an environment in which corrosion may occur due to sulfuric acid and hydrochloric acid, Cu, Co, Ni or Sb may be present as a single or composite concentration layer or may be present as a single or composite oxide film in a form of an oxide such as $Cu_xO$, $Co_xO$, $Ni_xO$, $Sb_xO$, $(Cu,Sb)_xO$, $(Cu,Co)_xO$, $(Cu,Ni)_xO$, $(Co,Sb)_xO$, $(Co,Ni)_xO$, $(Sb,Ni)_xO$, $(Cu,Sb,Co)_xO$, $(Cu,Sb,Ni)_xO$, $(Cu,Co,Ni_xO$, $(Sb,Co,Ni)_xO$, $(Cu,Sb,Co,Ni)_xO$, or the like. Whereby, wear resistance may be significantly improved. When the concentration layer has a thickness less than 100 nm, it may be difficult to secure an amount of corrosion of 3.0 mg/cm$^2$/Hr or less according to an embodiment of the inventive concept, such that difficulties in obtaining relatively excellent corrosion resistance may be present. As a thickness of the concentration layer is increased, the amount of corrosion is decreased, but when the thickness of the concentration layer exceeds 300 nm, effects of improvements in corrosion resistance may be relatively low, as compared to the addition of a large amount of an alloy. In addition, since manufacturing costs may be excessively increased, the concentration layer may have a thickness of 100 to 300 nm.

As described above, the steel sheet according to the embodiment may have an amount of corrosion of 3 mg/cm$^2$/Hr or less so as to secure significantly excellent corrosion resistance. In addition, since the steel sheet according to the embodiment may secure excellent tensile strength of 450 MPa or greater and thus a corrosion resistant layer thereof may be worn in an amount of 0.3 mm or less so as to secure excellent wear resistance in an environment in which corrosion may occur. In addition, surface defects may not occur.

Hereinafter, a method of manufacturing a steel sheet according to an embodiment will be described.

As described above, a steel slab having the component system proposed as described above may be reheated at a temperature of 1100 to 1300° C. The reheating may be a process performed such that an alloy element may be uniformly diffused internally, everywhere, in steel so as not to be segregated in any one region, such that movements of atoms may be actively undertaken in a hot rolling process, a cold rolling process and a winding process to be performed later. To this end, a reheating temperature may be 1100° C. or higher. However, when the reheating temperature exceeds 1300° C., an austenite crystal grain may be excessively grown to degrade the strength, and thus, the reheating temperature may be within a range of 1100 to 1300° C.

The reheated steel slab may be subjected to a finishing hot rolling process at a temperature of 850 to 950° C. to thus obtain a hot rolled steel sheet. When the finishing-rolling temperature is lower than 850° C., elongation may be significantly decreased due to the generation of elongated grains and material deviation per direction may be increased. When the finishing-rolling temperature exceeds 950° C., since crystal grains may be excessively grown to deteriorate strength, the finishing hot rolling temperature may be within a range of 850 to 950° C.

The obtained hot rolled steel sheet may be cooled at a temperature of 60 to 100° C./sec, based on a steel sheet surface temperature. Through the relatively high cooling rate as above, driving force required to move an alloy element suitable for corrosion resistance after the steel sheet is coiled may be increased. However, when the cooling rate is less than 60° C./sec, driving force may be decreased such that difficulties in allowing atoms to move are present. Therefore, defects in that an amount of corrosion resistant layers formed in a composite environment, in which composite corrosion may occur, is reduced may be present. As the cooling rate increases, the driving force for movements of atoms may be increased, but when the cooling rate exceeds 100° C./sec, an internal temperature may be lowered, such that recuperative heat is not actively operated and thus the movement of an alloy element suitable for forming the corrosion resistant layer may not be smooth. Thus, the cooling rate may be within a range of 60 to 100° C./sec. In detail, the cooling rate may be within a range of 70 to 100° C./sec.

Then, the steel sheet may be coiled at a temperature of 650 to 750° C. When the coiling temperature is lower than 650° C., the movement of atoms may not be easy in a coiling process, such that difficulties in forming a corrosion resistant layer may be present in an environment in which corrosion may occur. When the coiling temperature exceeds 750° C., crystal grains of the hot rolled steel sheet may be excessively grown to rapidly deteriorate steel strength. Therefore, the coiling temperature may be within a range of 650 to 750° C.

On the other hand, at the time of performing a coiling process, a steel sheet surface may have a temperature of 650° C. or higher by a recuperative heat phenomenon. Even when an internal temperature of the steel sheet is within a range of 650 to 750° C. through the cooling process, the surface of the steel sheet may have a temperature lower than that in the temperature range described above, due to rapid cooling of the steel sheet surface. Therefore, through the recuperative heat process, the movement of an alloy element suitable for forming the corrosion resistant layer may be active, and thus, the corrosion resistant layer may be formed to have a sufficient thickness. In order to obtain the sufficient effect as described above, the surface temperature of the steel sheet passed through the recuperative heat process may be 650° C. or higher, but even when the steel sheet has passed through a sufficient recuperative heat process, a surface temperature of the steel sheet may not easily exceed 750° C.

The coiled steel sheet may be slowly cooled to 300° C. or lower at a rate of 50 to 100° C./hr. When the cooling speed is excessively fast, since difficulties in forming the corrosion resistant layer may be present, the cooling speed may be 100° C./hr or lower, but when the cooling speed is less than 50° C./hr, the size of a crystal grain may be excessively great, to deteriorate steel strength. Thus, the cooling speed may be within a range of 50 to 100° C./hr. When the cooling stop temperature exceeds 300° C., an element forming the corrosion resistant layer, such as copper (Cu), cobalt (Co), nickel (Ni), or antimony (Sb), may not be sufficiently diffused on a surface thereof such that difficulties in forming the corrosion resistant layer may be present. Thus, the cooling stop temperature may be 300° C. or lower. A lower limit of the cooling stop temperature is not particularly limited as long as the above-mentioned condition according to the embodiment is satisfied. Accordingly, the cooling speed may be within a range of 50 to 100° C./hr. In detail, the cooling speed may be within a range of 50 to 90° C./hr.

Hereinafter, the inventive concept will be described in more detail through embodiments. The following embodiments may only be provided by way of examples so that the disclosure will be described in further detail to those skilled in the art, without limiting the scope of the invention.

Embodiment

A steel ingot having a component system as illustrated in the following table 1 was prepared, re-heated to a temperature of 1200° C. and then maintained thereat for one hour, and was then subjected to hot rolling at 900° C. to thereby manufacture a hot rolled steel sheet having a thickness of 4.5 mm. The hot rolled steel sheet sample was cooled to 600° C., based on a steel sheet surface temperature, on a run-out table at a rate of 80° C./sec, a cooling condition illustrated in the following table 2. The sample was coiled in a coiling furnace in a temperature condition illustrated in the following table 2, and was then cooled at a rate of 60° C./hr in the coiling furnace. The sample was extracted from the coiling furnace, and in this case, the temperature of the sample was 250° C., and the sample was then subjected to air cooling processing performed to room temperature. With respect to the samples manufactured as above, tensile strength was measured and whether or not surface defects occurred was checked, and in order to investigate corrosion characteristics in a composite corrosion condition of sulfuric acid-hydrochloric acid, the samples were immersed in a mixed solution of sulfuric acid of 16.9 vol % and hydrochloric acid of 0.35 vol % at a temperature of 60° C. for six hours and the amounts of corrosion occurring in the respective samples were measured. After the amounts of corrosion occurring in the respective samples were measured, the samples were cut to measure a thickness of cross sections of corrosion resistant layers. In addition, steel grit was sprayed to the sample having the size of 20 mm×30 mm for 30 minutes to allow the sample to be worn thereby and then a thickness of a worn portion of the sample in which the worn amount was greatest in a central portion thereof was measured to evaluate wear resistance properties.

TABLE 1

| | Alloy Composition (weight %) | | | | | | | | | | | |
|---|---|---|---|---|---|---|---|---|---|---|---|---|
| Classification | C | Si | Mn | P | S | Al | Cu | Ni | Sb | Co | Q | D |
| Embodiment 1 | 0.082 | 0.02 | 0.88 | 0.058 | 0.009 | 0.035 | 0.42 | 0.18 | 0.09 | 0.05 | 4.64 | 0.43 |
| Embodiment 2 | 0.067 | 0.02 | 0.86 | 0.069 | 0.011 | 0.029 | 0.44 | 0.22 | 0.12 | 0.03 | 5.83 | 0.50 |
| Embodiment 3 | 0.069 | 0.03 | 0.78 | 0.092 | 0.010 | 0.018 | 0.52 | 0.22 | 0.13 | 0.04 | 6.12 | 0.42 |
| Embodiment 4 | 0.078 | 0.02 | 0.92 | 0.124 | 0.008 | 0.032 | 0.57 | 0.25 | 0.14 | 0.0.6 | 6.46 | 0.44 |
| Comparative Example 1 | 0.035 | 0.38 | 0.54 | 0.010 | 0.012 | 0.030 | 0.30 | 0.21 | 0.08 | 0 | 5.05 | 0.70 |
| Comparative Example 2 | 0.065 | 0.04 | 0.62 | 0.130 | 0.009 | 0.041 | 0.32 | 0 | 0.11 | 0 | 10.33 | 0 |

TABLE 1-continued

| Classification | Alloy Composition (weight %) | | | | | | | | | | | |
|---|---|---|---|---|---|---|---|---|---|---|---|---|
| | C | Si | Mn | P | S | Al | Cu | Ni | Sb | Co | Q | D |
| Comparative Example 3 | 0.069 | 0.35 | 0.75 | 0.110 | 0.011 | 0.038 | 0.28 | 0.21 | 0.08 | 0 | 9.61 | 0.75 |
| Comparative Example 4 | 0.072 | 0.03 | 0.67 | 0.070 | 0.009 | 0.028 | 0.31 | 0.24 | 0 | 0 | 8.12 | 0.77 |
| Comparative Example 5 | 0.082 | 0.02 | 0.88 | 0.048 | 0.009 | 0.035 | 0.35 | 0.24 | 0.09 | 0.05 | 4.40 | 0.69 |

$4.0 \leq Q = 6 - 3 \times Cu - 0.3 \times Si - 5 \times Sb + 45 \times P\text{-}45 \times Co \leq 7.00.4 \leq D = Ni/((6 - 3 \times Cu - 0.3 \times Si - 5 \times Sb + 45 \times P - 45 \times Co)/3) \leq 0.6$

TABLE 2

| Classification | Cooling Speed (° C./sec) | Coiling Temperature (° C.) | Tensile Strength (MPa) | Whether defects occur | Corrosion Amount (mg/cm$^2$/Hr) | Thickness of Corrosion Resistant Layer (nm) | Wear Depth (mm) |
|---|---|---|---|---|---|---|---|
| Embodiment 1 | 80 | 700 | 455 | Good | 2.4 | 250 | 0.25 |
| Embodiment 2 | 80 | 700 | 487 | Good | 2.6 | 230 | 0.23 |
| Embodiment 3 | 80 | 700 | 507 | Good | 2.7 | 210 | 0.21 |
| Embodiment 4 | 80 | 700 | 521 | Good | 2.9 | 190 | 0.18 |
| Comparative Example 1 | 80 | 700 | 352 | Red Scale | 2.7 | 200 | 0.42 |
| Comparative Example 2 | 80 | 700 | 525 | Edge Cracks | 6.3 | 0 | 0.22 |
| Comparative Example 3 | 80 | 700 | 503 | Red Scale | 5.7 | 10 | 0.21 |
| Comparative Example 4 | 80 | 700 | 492 | Good | 5.4 | 30 | 0.24 |
| Comparative Example 5 | 30 | 500 | 465 | Good | 4.2 | 50 | 0.27 |

As can be seen in tables 1 and 2 above, in the cases of embodiments 1 to 4 satisfying the component system and the manufacturing conditions proposed according to the embodiment of the inventive concept, it can be seen that the amount of corrosion in an environment in which corrosion occurs due to sulfuric acid and hydrochloric acid is 3 mg/cm$^2$/Hr or lower, to exhibit relatively excellent corrosion resistance properties. In addition, it can be appreciated that since surface defects such as red scale, edge cracks or the like do not occur, a significantly good surface quality may be secured. Further, it may be confirmed that a wear depth of the corrosion resistant layer is 0.25 mm or less, and thus significantly excellent wear resistance may be provided while securing relatively excellent tensile strength of 450 MPa or higher.

However, in the case of comparative example 1, it could be appreciated that an excessive amount of silicon (Si) was added to cause the occurrence of red scale, and thus, relatively low tensile strength of 352 MPa was represented to deteriorate wear resistance properties.

In the case of comparative example 2, it could be appreciated that relatively high strength of 525 MPa was represented and wear resistance was excellent, while since a D value and a Q value did not satisfy the conditions provided according to an embodiment of the inventive concept due to the non-addition of nickel (Ni) and cobalt (Co) to thus cause the occurrence of cracks in an edge. In addition, it could be appreciated that since the corrosion resistant layer was not formed to have a sufficient thickness while having the amount of corrosion of 6.3 mg/cm$^2$/Hr therein, the comparative sample had significantly inferior quality as compared to the embodiments.

In the case of comparative example 3, it could be appreciated that an excessive amount of silicon (Si) was added, and thus red scale occurred, while a Q value also significantly deviated from the conditions provided according to an embodiment of the inventive concept, the amount of corrosion therein was 5.7 mg/cm$^2$/Hr, and thus a significantly inferior quality was provided in the comparative sample as compared to the embodiments.

In the case of comparative example 4, it could be appreciated that a surface defect did not occur, but since a Q value did not satisfy the conditions according to the embodiment of the inventive concept, a sufficient thickness of the corrosion resistant layer was not formed, providing a relatively low level of wear resistance.

In the case of comparative example 5, it could be appreciated that although a component system thereof is significantly similar to that of embodiment 1, the sample did not satisfy the manufacturing conditions according to the embodiment of the inventive concept, as well as a D value, such that the amount of corrosion therein was 4.2 mg/cm$^2$/Hr, providing significantly lower corrosion resistance as compared to that in the embodiments.

FIG. 1 is a graph illustrating a relationship between a Q value and an amount of corrosion in samples according to an embodiment of the inventive concept. As can be seen from FIG. 1, when a value of Q satisfies the conditions provided according to an embodiment of the inventive concept, the amount of corrosion may be 3.0 mg/cm$^2$/Hr or lower to have relatively excellent corrosion resistance, while when the value of Q is 6.0 or greater, deviating from the conditions provided according to an embodiment of the inventive concept, the amount of corrosion may exceed 3.0 mg/cm$^2$/Hr to cause deteriorated corrosion resistance.

FIG. 2 is a graph illustrating a relationship between tensile strength and a wear depth of samples according to an embodiment of the inventive concept. As can be seen from FIG. 2, as the strength is increased, a wear depth is reduced to thereby have relatively excellent wear resistance. In addition, when the conditions provided according to an embodiment are satisfied, relatively high strength may be realized to secure relatively excellent wear resistance while a lifespan of equipment is prolonged.

While the inventive concept has been shown and described in connection with the embodiments, it will be apparent to those skilled in the art that modifications and variations can be made without departing from the spirit and scope of the inventive concept as defined by the appended claims.

The invention claimed is:

1. A steel sheet for resistance to composite corrosion from sulfuric acid and hydrochloric acid, having excellent wear resistance and surface quality, the steel sheet comprising:

carbon (C) of 0.1 weight % or less (except for 0), silicon (Si) of less than 0.1 weight % (except for 0), manganese (Mn) of 0.5 to 1.5 weight %, sulfur (S) of 0.02 weight % or less, phosphorous (P) of greater than 0.03 to 0.15 weight %, aluminum (Al) of less than 0.05 weight %, copper (Cu) of 0.1 to 1.0 weight %, nickel (Ni) of 0.1 to 0.4 weight %, cobalt (Co) of 0.03 to 0.1 weight %, antimony (Sb) of 0.05 to 0.15 weight %, remaining iron (Fe), and other inevitably contained impurities; and a single or composite concentration layer formed of one or more selected from a group consisting of copper (Cu), cobalt (Co), nickel (Ni) and antimony (Sb) and formed directly under a surface of the steel sheet to have a thickness of 100 to 300 nm.

2. The steel sheet for resistance to composite corrosion of claim 1, wherein P has a content of 0.051 to 0.15 weight %.

3. The steel sheet for resistance to composite corrosion of claim 1, wherein the steel sheet is represented by the following relational expression, where Q has a value of 4.0 to 7.0, $$4.0 \le Q = 6 - 3\times Cu - 0.3\times Si - 5\times Sb + 45\times P - 45\times Co \le 7.0 \quad \text{Expression.}$$

4. The steel sheet for resistance to composite corrosion of claim 1, wherein the steel sheet is represented by the following relational expression, where D has a value of 0.4 to 0.6, $$0.4 \le D = Ni/((6 - 3\times Cu - 0.3\times Si - 5\times Sb + 45\times P - 45\times Co)/3) \le 0.6 \quad \text{Expression.}$$

5. The steel sheet for resistance to composite corrosion of claim 1, wherein the one or more selected from the group consisting of copper (Cu), cobalt (Co), nickel (Ni) and antimony (Sb) are present as the single or composite concentration layer in an environment in which corrosion occurs due to the sulfuric acid and the hydrochloric acid, or are present as a single or composite oxide film.

6. The steel sheet for resistance to composite corrosion of claim 1, wherein the steel sheet has an amount of corrosion of 3 mg/cm$^2$/Hr or lower.

* * * * *